United States Patent [19]

Krueger

[11] 4,273,261

[45] Jun. 16, 1981

[54] METERING APPARATUS

[76] Inventor: Wallace F. Krueger, 4401 Merriweather Rd., Toledo, Ohio 43623

[21] Appl. No.: 27,032

[22] Filed: Apr. 4, 1979

[51] Int. Cl.[3] ..... B67D 5/52

[52] U.S. Cl. ..... 222/135; 222/255; 222/288; 222/309; 417/341; 417/429; 417/339; 92/13; 92/136

[58] Field of Search ..... 222/129.3, 129.4, 135, 222/136, 145, 254, 255, 260, 261, 262, 263, 282, 288, 309, 249, 250, 334; 417/341, 429, 339, 344; 92/13, 136

[56] References Cited

U.S. PATENT DOCUMENTS

| | | | |
|---|---|---|---|
| 1,574,887 | 3/1926 | Hinds | 92/136 |
| 1,690,646 | 11/1928 | Meyer | 92/136 |
| 1,736,466 | 2/1956 | Rodth | 222/249 |
| 2,554,802 | 5/1951 | Waas | 222/309 X |
| 2,882,999 | 4/1959 | Morgan | 222/249 |
| 3,672,389 | 6/1972 | McConnell et al. | 417/429 |
| 4,142,654 | 3/1979 | Doubleday et al. | 222/309 |

FOREIGN PATENT DOCUMENTS

| | | | |
|---|---|---|---|
| 404432 | 6/1966 | Switzerland | 222/249 |

*Primary Examiner*—H. Grant Skaggs
*Attorney, Agent, or Firm*—Allen D. Gutchess, Jr.

[57] ABSTRACT

Apparatus for metering material and transferring it from one location is provided. The new metering apparatus has several advantages over that disclosed in my U.S. Pat. No. 4,118,799. The apparatus includes a pair of cylinders with rams which are reciprocated in opposite directions by gear racks connected thereto and driven by a common pinion. A plurality of pairs of the cylinders and rams can be mounted on a common frame or base to meter a number of different materials. Also, the rams, with or without the cylinders, can be readily replaced with components of different diameters to provide different metered quantities of materials. In addition, mechanism are provided for changing the stroke lengths of one or more pair of rams when two or more pairs are employed.

19 Claims, 8 Drawing Figures

METERING APPARATUS

This invention relates to apparatus for metering quantities of materials and for transferring the metered quantities from one location to another.

Apparatus according to the invention is particularly advantageous for metering precise quantities of highly viscous material but is also effective for use with lower viscosity materials. As disclosed in my U.S. Pat. No. 4,118,799, the basic apparatus includes at least one pair of cylinders in which rams are located, with drive means for reciprocating the rams in opposite directions in the cylinders. A source of material under relatively low positive pressure communicates with inlets at the blind ends of the cylinders, with the inlets having ball check valves for enabling the flow of the material only toward the respective cylinders. A common outlet communicates with outlets at the opposite or rod ends of the cylinders with the outlets also having ball check valves enabling flow of the material only away from the cylinders. Back pressure means are also provided to maintain a higher pressure of the metered material at the common outlet than at the inlets.

In accordance with the invention, the rams are reciprocated in the cylinders in opposite directions by parallel gear racks which are connected to the rams outside the cylinders, the racks being in mesh with a common pinion. This drive arrangement enables the rams to reciprocate in true lineal motions. Also, the drive arrangement is more compact than the rocker arm drive shown in the aforesaid patent. Preferably, single-acting, fluid-operated cylinders have pistons connected to the racks at the ends opposite the rams. Fluid under pressure is applied to the cylinders alternately to move the corresponding ram in a direction into its cylinder and at the same time, through the pinion, to move the other ram in a direction out of its cylinder.

The cylinders, rams, and drive mechanisms are designed so that a plurality of pairs of the cylinders and rams can be mounted on a common framework or base to meter a number of different liquids. For example, a number of different colored catalytic paints might be employed and need to be readily available for painting new automobiles. In such an instance, the paints not being used would be recirculated by the metering cylinders and rams until needed.

For changing metered quantities of materials, the rams can be uncoupled from the gear racks and the cylinders removed from the framework, with both then being replaced by rams and cylinders of another size. Also, the rams alone can be uncoupled from the racks and replaced in the same cylinders with rams of different sizes, along with packing glands having inner diameters of the size of the new rams. The displacement of the rams determines the metered quantities although with rams which are substantially smaller in diameter than the cylinders, the self-cleaning action obtained with rams and cylinders of more nearly equal diameters is not achieved. However, the self-cleaning characteristic is not as important for less viscous, homogeneous materials, such as paints.

When two or more pairs of rams, cylinders, and drive means are employed, the pinions of the drive means are coupled together so that the strokes of the rams will be synchronized. Even though the strokes are synchronized, however, means can be provided to change the length of the strokes of at least one pair of the rams so as to change the metered quantity. This can be accomplished through an adjustable lever mechanism which changes the degree of oscillation of one or more pinions to thereby change the stroke length of the gear racks with which it is engaged. Fluid controls for the drive cylinders can also be employed to change the stroke length of all of the gear racks and rams.

It is, therefore, a principal object of the invention to provide improved apparatus for metering precise quantities of material and transferring it from one location to another.

Another object of the invention is to provide metering apparatus comprising a pair of cylinders having rams which are reciprocated by gear racks which are in mesh with a common pinion.

A further object of the invention is to provide a plurality of pairs of cylinders and rams mounted on a common framework for metering a plurality of different materials.

Yet another object of the invention is to provide pairs of cylinders and rams for metering quantities of materials, the rams, with or without the cylinders, being readily replaceable by components of different sizes for metering different quantities of materials.

Yet a further object of the invention is to provide at least two pairs of cylinders with rams reciprocated by racks and pinions with means for changing the lengths of the strokes of at least one pair of the rams.

Other objects and advantages of the invention will be apparent from the following detailed description of preferred embodiments thereof, reference being made to the accompanying drawings, in which.

Figure 1:
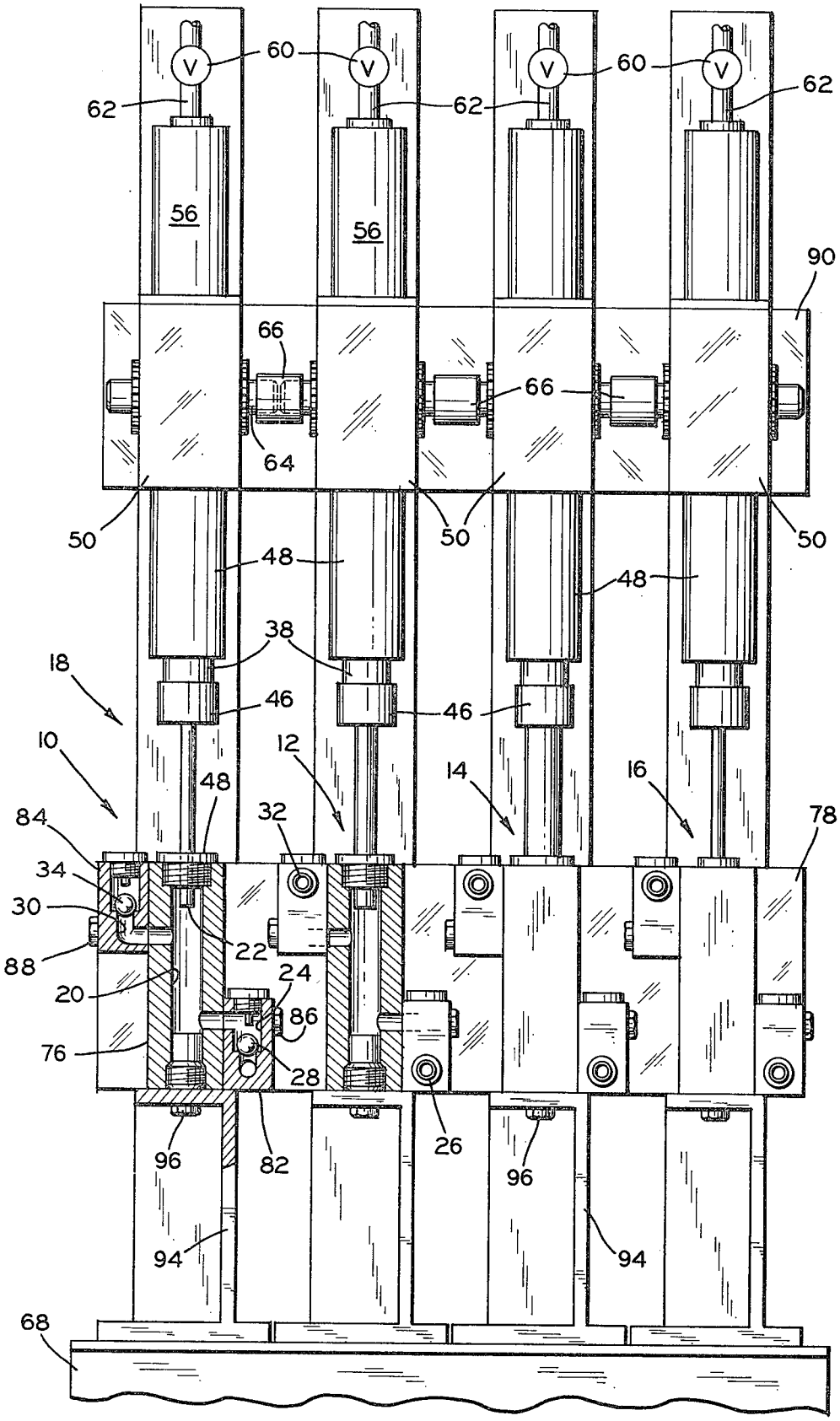
FIG. 1 is a front view in elevation, with parts broken away and with parts in section, of a plurality of pairs of rams, cylinders, and drive mechanisms in accordance with the invention.
Figure 2:
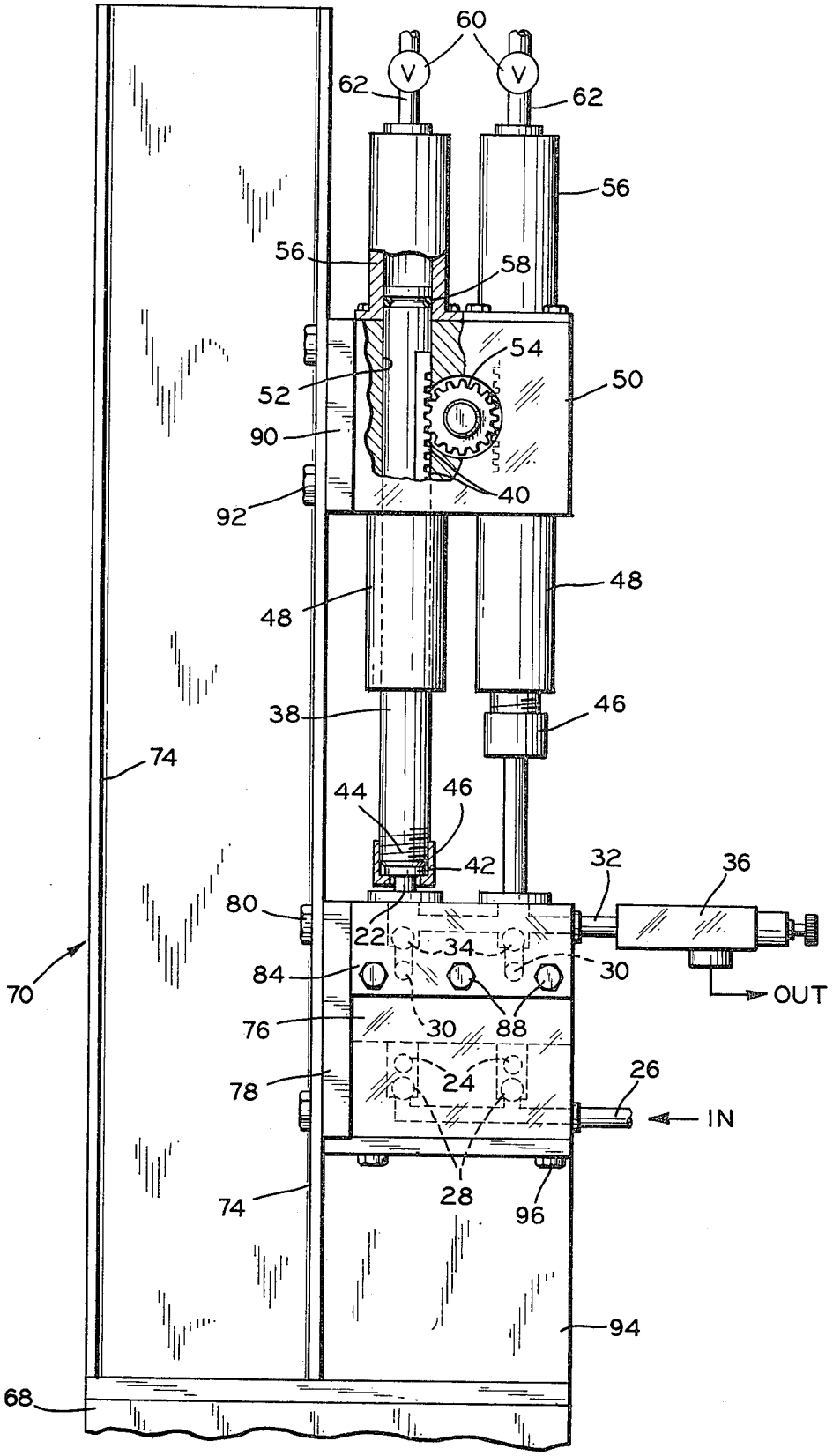
FIG. 2 is a left end view in elevation, with parts broken away and with parts in section, of a pair of the cylinders, rams, and drive mechanism of FIG. 1.
Figure 3:
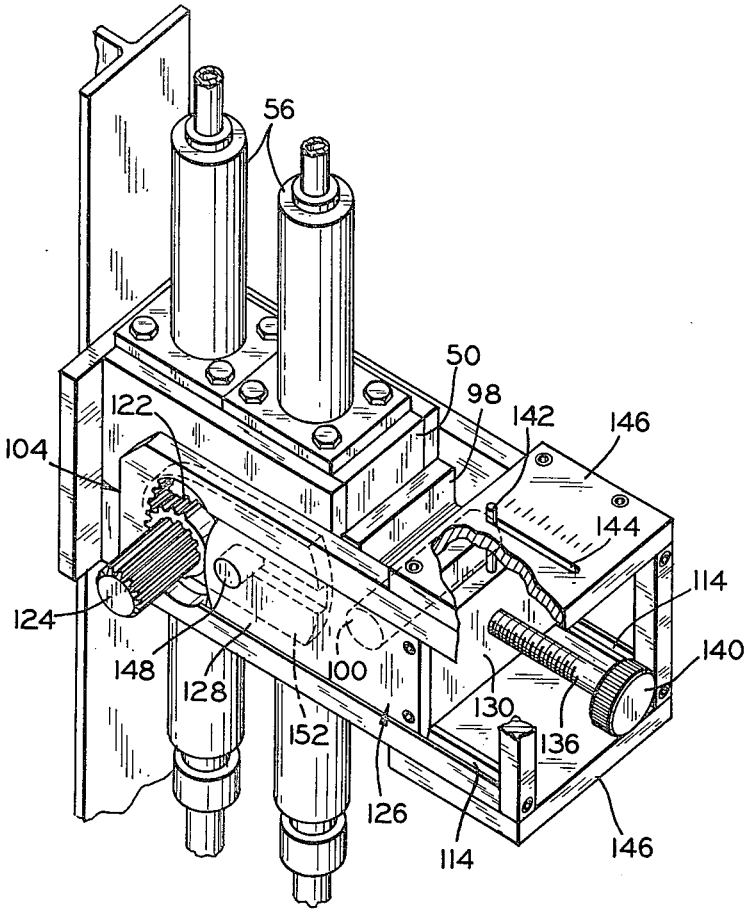
FIG. 3 is a fragmentary view, with parts broken away and with parts in section, of mechanism for changing the lengths of strokes of a pair of the rams.
Figure 4:
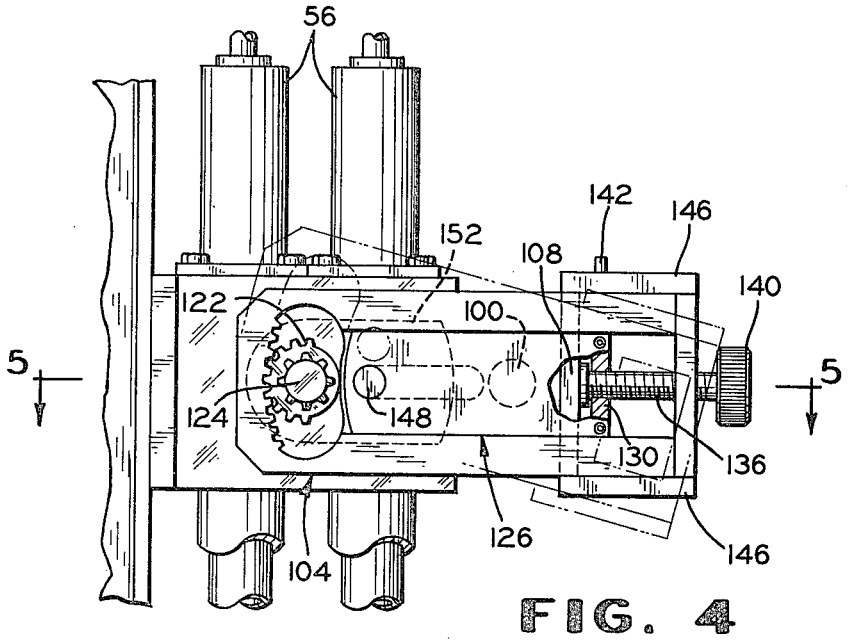
FIG. 4 is a side view in elevation of the mechanism of FIG. 3, with a different position being shown in dotted lines for part of the mechanism.
Figure 5:
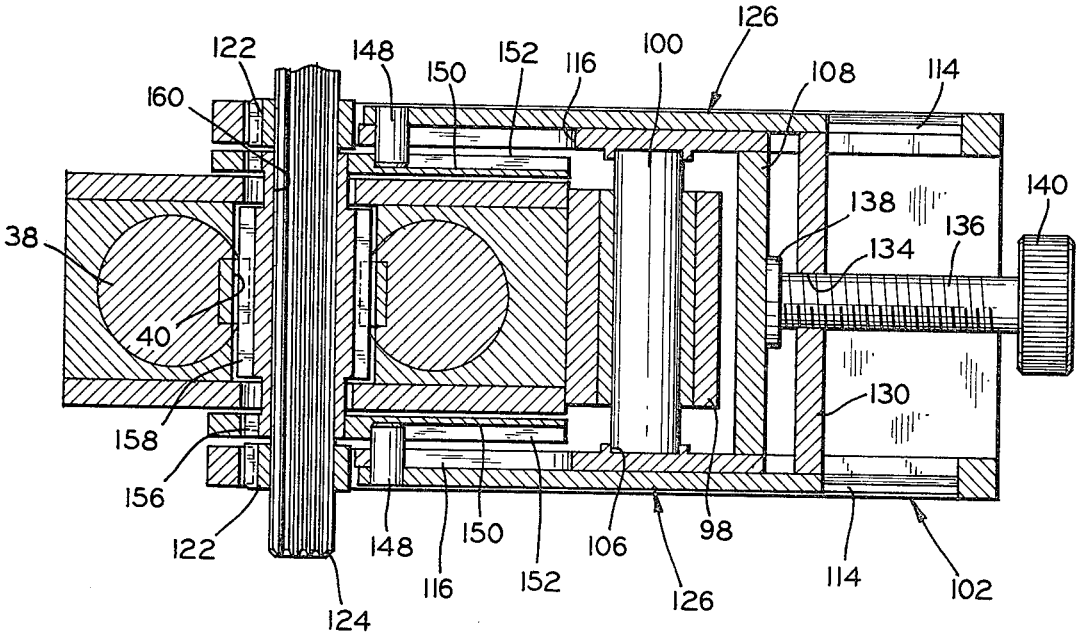
FIG. 5 is a view in horizontal cross section, taken along the line 5—5 of FIG. 4.
Figure 6:
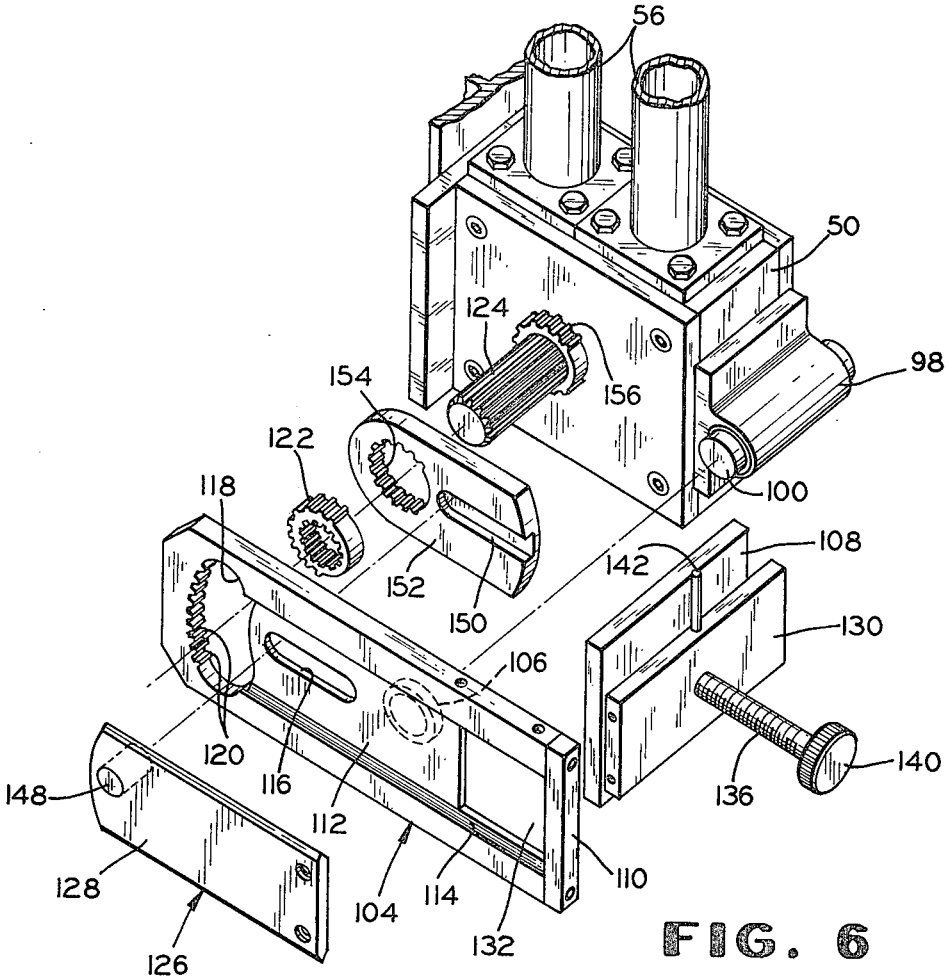
FIG. 6 is an exploded view in perspective of certain components of the mechanism of FIGS. 3–5.

Referring to the drawings, and particularly to FIGS. 1 and 2, a plurality of pairs 10, 12, 14, and 16 of metering devices are mounted on a common frame or framework 18. While only four pair are shown, the number could be much greater if the need arose. Each pair of metering devices basically includes cylinders 20 and rams 22. The cylinders 20 have inlets 24 at the blind ends thereof connected by a common line 26 to a suitable source (not shown) of material which is to be metered. The material of the source is maintained under relatively low positive pressure, the material either being elevated or maintained under pressure in a closed vessel. The inlets 24 have ball check valves 28 therein which enable flow of the material only toward the cylinders 20 from the source. The cylinders 20 also have outlets 30 at the rod ends thereof which communicate with a common outlet line 32. The outlets 30 have ball check valves 34 which enable flow of the metered material only away from the cylinders 20. The common outlet line 32 communicates with an adjustable back pressure valve 36 which can be of the type shown in my U.S. patent application, Ser. No. 901,689, now U.S. Pat. No. 4,171,191. This valve maintains the pressure of the metered material at the outlet line 32 above the pressure of the material at the inlets 24. Otherwise, the material could flow through the cylinders 20 without being metered at all. At the same time, positive pressure is required at the inlet 24 to prevent possible cavitation or only partial filling of the material in the cylinder as the ram 22 is raised. This would result in inaccurate metering.

The ram 22 is connected to a gear rack 38 having teeth 40, the ram 22 having an enlarged head 42 which is held against a threaded end 44 of the gear rack 38 by a coupling nut 46. With this arrangement, the ram 22 can be quickly disconnected from the gear rack 38 and removed from the cylinder 20. If a different metered quantity of material is desired, the ram 22 can be replaced with one of a different diameter as long as it does not exceed the diameter of the cylinder 20, of course. A different seal or packing gland 48 would then be employed, having the same outer diameter but with a different inner diameter to match the different sized ram. If desired, the block forming the cylinder 20 can also be replaced with a block having a cylinder of different diameter, similar to the diameter of the new ram. The quantity of metered material is determined by the diameter of the ram 22 with larger rams metering larger volumes of material. However, with a smaller diameter ram, as compared to the diameter of the cylinder, the action of the ram and cylinder will not be selfcleaning. This is not a problem except for some of the highly viscous materials. Also, rams and cylinders of similar diameters should be used for nonhomogeneous liquid.

The gear racks 38 extend through guide sleeves 48 which depend from a housing 50. The housing 50 has vertical bores 52 therein which back up the gear racks 38 at the teeth 40 which are engaged by a common pinion 54 in the housing. The pinion 54 engages the teeth 40 of both of the gear racks 38 to assure that the strokes of the rams 22 connected thereto are equal and opposite. Above the housing 50, there are single-acting, fluid-operated cylinders 56 having pistons 58 which are connected to the gear racks 38. Suitable valves 60 at fluid inlet lines 62 supply fluid under pressure alternately to the single-acting cylinders 56 to urge the pistons 58 and the gear racks 38 downwardly. When one of the gear racks 38 is urged downwardly by fluid under pressure, the opposite gear rack 38 is moved equally upwardly through the common pinion 54.

The pinions 54 are mounted on splined shafts 64 which extend outwardly from the housings 50. The shafts 64 of the pairs 10–16 of metering devices can then be coupled together by suitable coupling sleeves 66 to synchronize the strokes of the rams of the various pairs. Particularly with lower viscosity fluids and lower pressures, an outer end of one of the shafts 64 could be driven to drive the rams of all four pair of metering devices.

The frame 18 on which the pairs of metering devices are mounted includes a frame base 68 with upright frame members or H-beams 70 extending upwardly therefrom and having webs 72 and flanges 74. Cylinder blocks 76 for the cylinders 20 can be affixed to the front flanges of 74 of the upright frame members 70 through a horizontal frame bar 78 and fasteners or bolts 80. Also, inlet blocks 82 for the inlets 24 and outlet blocks 84 for the outlets 34 can be fastened to the cylinder block 76 by fasteners or bolts 86 and 88. The inlet and outlet blocks can then be used with other cylinder blocks as modular assemblies. Thus, all of the inlets, outlets and check valves need not be replaced when a different size of the cylinder 22 is desired. Similarly, the drive housings 50 can be mounted to the flanges 74 by an upper horizontal frame member or bar 90 and fasteners 92. The cylinders 20 can further be supported by lower frame members or stands 94, if desired, the cylinders being affixed by suitable fasteners 96. The frame 18 thus provides the high degree of rigidity required when the metering pairs 10–16 of metering devices are metering highly viscous material. At the same time, the rams 22 and the cylinders 20 can be readily removed and replaced.

While the quantities of material being metered can be changed by changing the size of the rams 22 or by changing the lengths of the strokes of all of the rams, to be discussed subsequently, the length of the strokes of one pair of the rams can also be changed to change one quantity and the ratio of the metered quantities. Referring to FIGS. 3–6, mechanism for accomplishing a change in stroke length is shown. Accordingly, a pivot block 98 mounted on the front of the housing 50 carries a pivot pin 100. A U-shaped adjusting bracket 102 has a pair of parallel supporting arms 104 with recesses 106 pivotally mounted on the pin 100 and connected by a base block 108. Each of the rams 104 has a thicker frame 110 with a thinner web 112 and adjacent upper and lower grooves 114. The web 112 also has an elongate slot 116 extending longitudinally of the arms 104. Ends of the frame 110 have arcuate, elongate openings 118 with teeth 120 formed on the back edge thereof. The teeth 120 engage a pinion gear 122 mounted for rotation with a splined shaft 124. The shaft 124 can be connected to one of the shafts 64 of another pair of metering devices such as the pairs 10–16. The shaft 124 oscillates through a fixed angle, preferably 90 degrees, and accordingly oscillates the arms 104 about the pivot pin 100 through a fixed angle. The arms 104 are shown in dotted lines in FIG. 4 at one extreme position of the oscillations.

A slidable bracket 126 is carried by the adjusting bracket 102. Specifically, the bracket 126 has pin arms 128 having upper and lower edges slidably supported in the grooves 114 of the arms 104. The pin arms 128 are connected by a base leg 130 which extends through rectangular openings 132 formed at the ends of the frame 110 beyond the ends of the webs 112. The leg 130 has a threaded opening 134 through which extends a threaded shaft 136 rotatably mounted at 138 on the base leg 108 and having an adjusting knob 140. The leg 130 also has an indicator pin 142 extending upwardly therefrom and through a slot 144 in an upper one of two panels 146 connected between the edges of the supporting arms 104. When the shaft 136 is turned, it moves the pin arms 128 back and forth and accordingly moves hardened steel pins 148 back and forth. The pins 148 extend through the elongate slots 116 in the webs 112 and are engaged in open ended grooves 150 in crank arms 152. At the ends opposite the grooves 150, the crank arms 152 have splined openings 154 which are affixed to splined extensions 156 of a pinion 158. The pinion 158 has a central bore 160 through which the splined shaft 124 extends but the pinion and shaft are rotatable relative to one another.

In operation, when the arms 104 oscillates, they oscillate the slidable arms 128 through the same fixed angle. The pins 148, engaged in the grooves 150, oscillate the crank arms 152. These, in turn, oscillate the pinion extensions 156 and the pinion 158. The pinion 158 then controls the length of the strokes of the racks 38 and accordingly controls the length of the strokes of the rams to which they are connected.

The extent of oscillation of the crank arms 152, the pinion extensions 156, and the pinion 158, depends upon the position of the pins 148 relative to the grooves 150 in the crank arms 152. When the pins 148 are near the closed ends of the grooves 150, near the splined openings 154, maximum oscillation of the crank arms 152 occurs. Accordingly, maximum oscillation of the pinion 158 also occurs and maximum stroke length of the racks 38 and rams is achieved. Oppositely, when the threaded shaft 134 is turned to move the base legs 130 outwardly so that the pin arms 128 are accordingly moved outwardly and the pins 148 engage the grooves 150 near their open ends, minimum oscillation or arcuate movement of the crank arms 152 occurs. Similarly, minimum arcuate movement of the racks 38 occur and the strokes of the rams is also minimum. Hence, it will be seen that the stroke lengths of the rams and the gear racks 38 can be changed by the position of the slidable bracket 126.

If desired, the fluid-operated cylinders 56 can be used in the same manner as before to aid in driving the racks 38 and the rams 22. However, the power supplied by the cylinders 56 is not sufficient to override the oscillating drive through the splined shaft 124 so that the stroke length is still controlled through the brackets 102 and 126.

Figure 7:
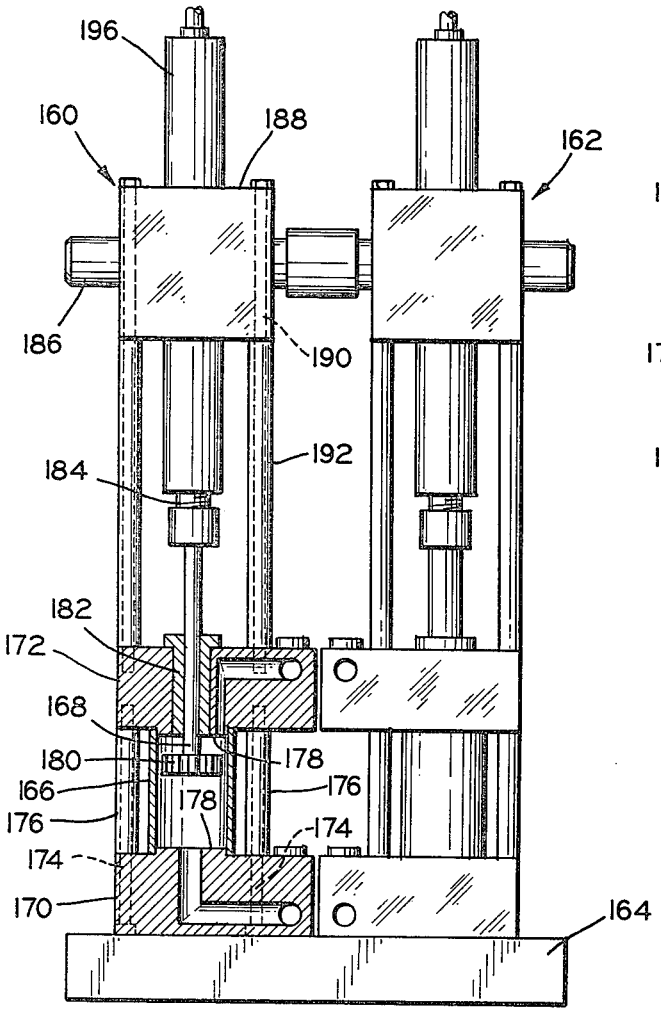
FIG. 7 is a view similar to FIG. 1 of a modification of the apparatus of FIG. 1.
Figure 8:
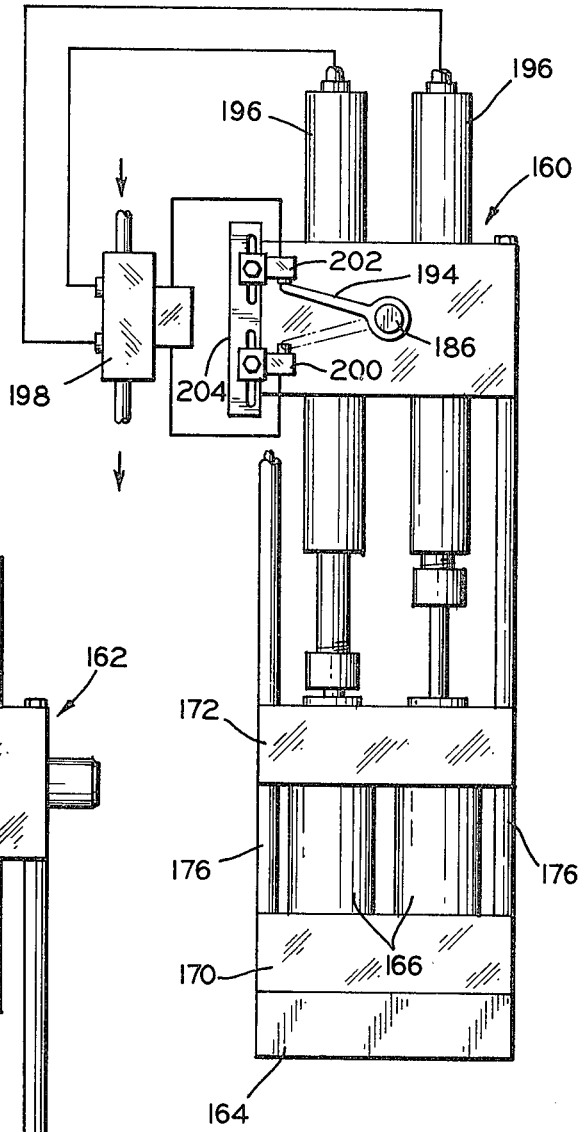
FIG. 8 is a view similar to FIG. 2 of the modified apparatus along with fluid controls.

Referring to FIGS. 7 and 8, two pair 160 and 162 of modified metering devices are mounted on a common base 164. The metering devices of FIGS. 7 and 8 differ from those of FIGS. 1 and 2 in the framework employed and in the modular construction of the cylinders and valves. Control means for changing the stroke lengths of all of the rams are also shown in FIG. 8.

Each pair of metering devices includes cylinders 166 and rams 168. An inlet block 170 is located at the lower ends of the cylinders 166 and an outlet block 172 is located at the upper end of the cylinder. These are connected through suitable threaded rods 174 and spacer tubes 176 which hold the cylinders 166 in place with the aid of raised cylindrical portions 178 on the blocks 170 and 172. With this arrangement, the blocks can be separated and the cylinders 166 changed, if desired. The blocks 170 and 172 have inlets, outlets, and check valves similar to those of FIGS. 1 and 2 and will not be discussed further.

Each of the rams 168, in this instance, has an enlarged head 180 which has a diameter close to the inner diameter of the cylinder 166. In this manner, the head 180 keeps the material in the cylinder being metered in motion to prevent portions settling out, when non-homogeneous materials are being used. The ram 168 extends through a seal or packing gland 182 which can be changed in the block 172 when a different sized ram is to be used. The ram 168 is connected to a gear rack 184 which is driven by a pinion in the same manner as the metering devices in FIGS. 1 and 2. A common shaft 186 connects the pinions of the two pair 160 and 162 to synchronize their strokes.

The pinions for the gear racks 184 are located in housings 188 and are supported above the outlet blocks 172 through suitable threaded rods 190 and spacer tubes 192. As such, each of the pair 160 and 162 of metering devices are independent except for the common base 164. The supporting framework, in this instance, is lighter in weight than the framework of FIGS. 1 and 2 and can be employed where lower pressures and less viscous materials are involved.

To change the length of the strokes of the gear racks 184 and the rams 168, the common shaft 186 extends outwardly beyond the side of the housing 188 where it is connected to an arm 194 which oscillates therewith. The gear racks 184 are connected to pistons in fluid-operated cylinders 196 which are supplied with fluid under pressure and are exhausted by a four-way valve 198. The valve 198 is controlled through two pilot air valves 200 and 202 which are adjustably mounted on a bracket 204 suitably affixed to the housing 188. The pilot valves 200 and 202 can be moved toward and away from one another to control the stroke length of the gear racks and rams. Each time one of the valves 200 and 202 is engaged by the arm 194, it switches the four-way valve 198 to reverse the travel of the gear racks and rams. However, the rams can also be operated one stroke at a time, if desired.

Various modifications of the above described embodiments of the invention will be apparent to those skilled in the art, and it is to be understood that such modifications can be made without departing from the scope of the invention, if they are within the spirit and the tenor of the accompanying claims.

I claim:

1. Apparatus for metering material comprising means forming a first cylinder having a first ram reciprocable therein, first inlet means connected to said first cylinder for supplying material to said first cylinder, said first inlet means having a first check valve enabling flow of the material only toward said first cylinder, first outlet means connected to said first cylinder for receiving metered material from said first cylinder, said first outlet means having a second check valve enabling flow of the material only away from said first cylinder, means forming a second cylinder having a second ram reciprocable therein, second inlet means connected to said second cylinder for supplying material to said second cylinder, said second inlet means having a third check valve enabling flow of the material only toward said second cylinder, second outlet means connected to said second cylinder for receiving metered material from said second cylnder, said second outlet means having a fourth check valve enabling flow of the material only away from said second cylinder, a first gear rack connected to said first ram, a second gear rack connected to said second ram, a pinion between said racks and meshing with both, and means for driving said first gear rack and second gear rack comprising a fluid-operated cylinder connected with each of said gear racks.

2. Apparatus according to claim 1 characterized by means for changing the length of the strokes of said gear racks.

3. Apparatus according to claim 2 characterized by said length-changing means being connected to said pinion.

4. Apparatus according to claim 1 characterized by means for controlling fluid to said cylinders to control the length of the strokes of said gear racks.

5. Apparatus for metering material comprising a first pair of cylinders having first rams reciprocable therein, first inlet means connected to said first pair for supplying material thereto, first outlet means connected to said first pair for receiving metered material therefrom, a second pair of cylinders having second rams reciprocable therein, second inlet means connected to said second pair for supplying material thereto, second outlet means connected to said second pair for receiving metered material therefrom, a first pair of gear racks connected to said first rams of said first pair, a first pinion between said first pair of gear racks and meshing with both, a second pair of gear racks connected to said second rams of said second pair, a second pinion between said second pair of gear racks and meshing with both, driving means for driving said gear racks comprising fluid-operated cylinders connected to said gear racks, and coupling means for connecting said first and second pinions so that said first and second pinions move in synchronization.

6. Metering apparatus according to claim 5 characterized by said coupling means comprising means for changing the length of the strokes of said second rams.

7. Apparatus according to claim 6 characterized by said length-changing means being connected to said second pinion.

8. Apparatus according to claim 5 characterized by means for controlling fluid to said cylinders to control the length of the strokes of said gear racks.

9. Apparatus according to claim 8 characterized by said fluid control means comprising an arm affixed to one of said pinions and oscillatable therewith.

10. Apparatus according to claim 9 characterized by said fluid control means further comprising a four-way valve connected to at least one of said fluid-operated cylinders and two pilot valves connected to said four-way valve and engageable by said pinion arm.

11. Apparatus according to claim 10 characterized by a framework supporting said cylinders, said pilot valves being adjustably mounted on said framework.

12. Apparatus according to claim 5 characterized by said coupling means comprising a crank arm connected to said second pinion, a movable arm having means to engage said crank arm, and means connected to said first pinion for oscillating said movable arm through a fixed angle and including means for moving said movable arm toward and away from said crank arm to change the point of engagement of said engaging means with said crank arm.

13. Apparatus according to claim 12 characterized by said crank arm having a groove and said engaging means being a pin extending into said groove.

14. Apparatus according to claim 13 characterized by said moving means comprising a threaded rod, and means connecting said threaded rod with said movable arm whereby when said threaded rod is turned, said movable arm is moved toward and away from said crank arm.

15. Apparatus for metering material comprising a first pair of cylinders having first rams reciprocable therein, first inlet means connected to said first pair for supplying material thereto, first outlet means connected to said first pair for receivig metered material therefrom, a second pair of cylinders having second rams reciprocable therein, second inlet means connected to said second pair for supplying material thereto, second outlet means connected to said second pair for receiving metered material therefrom, a first pair of gear racks connected to said first rams of said first pair, a first pinion between said first pair of gear racks and meshing with both, a second pair of gear racks connected to said second rams of said second pair, a second pinion between said second pair of gear racks and meshing with both, means for driving at least one of said gear racks, a shaft connected with said first pinion and rotatable therewith, said shaft extending toward said second pinion and rotatable independently thereof, an additional gear mounted on said shaft and rotatable therewith, means engagable with said additional gear and oscillated thereby, and adjustable means connecting said engagable means and said second pinion for oscillating said second pinion through adjustable angles relative to said engagable means.

16. Apparatus for metering material according to claim 15 characterized by said adjustable means comprising oscillatable means oscillated by said engagable means and having a pivot pin adjustable relative to said engagable means, and arm means connecting said oscillatable means and said second pinion.

17. Apparatus for metering material comprising a pair of cylinders having rams reciprocable therein, inlet means connected to said pair of cylinders for supplying material thereto, outlet means connected to said pair of cylinders for receiving metered material therefrom, a pair of gear racks connected to said rams of said pair, a pinion between said pair of gear racks and meshing with both, a shaft extending through said pinion and rotatable independently thereof, means for rotating said shaft, a gear mounted on said shaft and rotatable therewith, means engagable with said gear and oscillated thereby, and adjustable means connecting said engagable means and said pinion for oscillating said pinion through adjustable angles relative to said engagable means.

18. Apparatus for metering material according to claim 17 characterized by said adjustable means comprising oscillatable means oscillated by said engagable means and having a pivot pin adjustable relative to said engagable means, and arm means connecting said oscillatable means and said second pinion.

19. Apparatus for metering material according to claim 17 characterized by a fluid-operated cylinder connected with each of said gear racks.

* * * * *